US010322329B2

(12) United States Patent
Hammann

(10) Patent No.: US 10,322,329 B2
(45) Date of Patent: Jun. 18, 2019

(54) FOOTBALL RECEIVING AND THROWING MACHINE

(71) Applicant: Derek Henry Hammann, Iowa City, IA (US)

(72) Inventor: Derek Henry Hammann, Iowa City, IA (US)

( * ) Notice: Subject to any disclaimer, the term of this patent is extended or adjusted under 35 U.S.C. 154(b) by 0 days.

(21) Appl. No.: 16/152,101

(22) Filed: Oct. 4, 2018

(65) Prior Publication Data

US 2019/0105549 A1 Apr. 11, 2019

Related U.S. Application Data

(60) Provisional application No. 62/568,944, filed on Oct. 6, 2017.

(51) Int. Cl.

| | |
|---|---|
| ***F41B 4/00*** | (2006.01) |
| ***A63B 69/40*** | (2006.01) |
| ***A63B 63/08*** | (2006.01) |
| *A63B 63/00* | (2006.01) |

(52) U.S. Cl.

CPC ..... *A63B 69/406* (2013.01); *A63B 63/08* (2013.01); *A63B 2063/001* (2013.01); *A63B 2069/402* (2013.01); *A63B 2243/007* (2013.01)

(58) Field of Classification Search

CPC ..... A63B 69/40; A63B 69/402; A63B 69/406; A63B 2063/001; A63B 69/002; F41B 4/00

See application file for complete search history.

(56) References Cited

U.S. PATENT DOCUMENTS

| | | | | |
|---|---|---|---|---|
| 4,026,261 | A * | 5/1977 | Paulson | A63B 69/406 124/78 |
| 4,596,230 | A * | 6/1986 | Griffith | A63B 69/406 124/50 |
| 4,723,532 | A * | 2/1988 | Osojnak | A63B 69/406 124/48 |
| 6,224,503 | B1 * | 5/2001 | Joseph | A63B 63/083 124/6 |
| 6,241,628 | B1 * | 6/2001 | Jenkins | A63B 69/0071 124/6 |
| 6,877,501 | B2 | 4/2005 | Wojtkiewiscz | |
| 7,553,244 | B2 | 6/2009 | York | |
| 8,932,156 | B2 | 1/2015 | Boehner | |
| 9,022,016 | B1 | 5/2015 | Hafer | |
| 2017/0326414 | A1 * | 11/2017 | York | A63B 63/08 |

* cited by examiner

*Primary Examiner* — John A Ricci
(74) *Attorney, Agent, or Firm* — Dave I. Ellingson

(57) ABSTRACT

A machine and method for receiving and launching an oval football. The machine includes a football catch area, a motorized belt to orient the football and motorized wheels to launch the football. The user catching the football throws it back to the machine. The machine automatically orients the football and launches it back to the user catching the football. The machine provides the user a consistent timing pause between receiving the football and launching of the football.

20 Claims, 21 Drawing Sheets

FOOTBALL RECEIVING AND THROWING MACHINE

CROSS-REFERENCE TO RELATED APPLICATIONS

This application claims priority to U.S. Provisional Patent Application Ser. No. 62/568,271 filed Oct. 6, 2017, titled "Football Receiving and Throwing Machine", the entire contents of which is incorporated herein, both bodily and by reference.

FEDERALLY SPONSORED RESEARCH

Not Applicable

SEQUENCE LISTING OR PROGRAM

Not Applicable

FIELD OF THE INVENTION

The present invention relates to an oval football throwing machine being loaded manually by an individual and then released through the use of force from the individual through the machine to the person catching the football. Furthermore, the present invention relates to an oval football receiving and throwing machine. The person catching the football throws it back to the machine. The machine automatically orients the football and throws it back to the person catching the football.

BACKGROUND OF THE INVENTION

Football throwing machines have been in use since the early 1990's. Virtually every college football program, professional football organization, and thousands of high schools across America use a football throwing machine to better their athletes. The machine is designed to provide a consistent throw to athletes who desire to improve their abilities to catch a football. The machine provides the ability to adjust the speed of the ball as well as the location of the ball through adjusting the machine's position. However, a large inefficiency exists with this machine as it requires an individual other than the person catching the footballs to be present. The individual loading the football and manually pushing the ball through the machine gets absolutely no value or skill development from doing so. This makes it very difficult for athletes who want to work on catching the football to get better because it is hard to find someone willing to load balls into a machine for an extended period of time.

An example prior art football throwing machine is disclosed in U.S. Pat. No. 8,932,156 entitled "System and Method To Pitch Footballs", issued Jan. 13, 2015.

Another example prior art football throwing machine is disclosed in U.S. Pat. No. 9,022,016 entitled "Football Throwing Machine", issued May 5, 2015. This prior art includes a magazine for loading several footballs. This partially alleviates the issue of having a individual present at the machine during operation.

An example prior art football receiving and throwing machine is disclosed in U.S. Pat. No. 7,553,244 entitled "Ball Receiving And Launching Machine", issued Jun. 30, 2009. This patent has a limitation in the way that the football is funneled. This patent uses a netting with two sloped sides and vibration technology to orient the football nose first.

This is inefficient as well as inconsistent. Depending on how the ball falls into the two sided sloping funnel the ball can potentially sit at the point of orientation for an extended period of time where it is being vibrated in an attempt to orient the football correctly. This is inefficient as a player catching footballs wants the process to be as rhythmic as possible. This patent does not offer the ability to achieve this important outcome due to its orienting method of the football.

Another example prior art football receiving and throwing machine is disclosed in U.S. Pub. No. 2017/0326414 entitled "Oval Football Receiving And Launching Machine And Method", published Nov. 16, 2017.

The disclosure of each of the above cited U.S. patents and U.S. patent application Publications is incorporated by reference herein.

SUMMARY OF THE INVENTION

The present invention provides the user a consistent timing pause between throwing the football and launching of the football. This consistent practice rhythm is important to develop proper footwork and football catching skills. The football follows a predictable path through the collector chute, along the orienting belt, and through the drive wheels. There are no variable pauses waiting on vibration to get the football back moving.

Another feature of the present invention is that the football launch closely resembles a quarterback pass in height, speed, arc and spin. The machine legs are sized to create the proper football launch height. The variable speed drive motors provide accurate football speed. The drive motor carrier system includes a precise four bar linkage adjustment to change the football launch angle. The football spin can be changed from RH to LH with individual adjustments of the motor positions. The football rotation speed can also be adjusted with motor positions.

Another feature of the present invention is the reduction in jamming of the football in the mechanism. The drop opening of the football from the collector to the belt is sufficiently large to preclude any jam. As the football is oriented, a single angled side and rollers are used to keep friction low.

REFERENCE NUMERALS

| | |
|---|---|
| 10 Machine | 11 Football |
| 12 Throwing path | 13 Collector |
| 14 Control | 15 Caster |
| 16 Support | 17 Guard |
| 18 Left wheel | 20 Launching path |
| 21 Front legs | 22 Back legs |
| 23 Frame | 24 Right wheel |
| 25 Handle | 26 Carrier |
| 30 Opening | 34 Right fence |
| 35 Left fence | 36 Rear fence |
| 37 Kicker | 38 Shelf |
| 39 Belt | 46 Left rollers |
| 47 Right rollers | 50 Motor |
| 51 T handle | 52 Arc slot |
| 53 Belt board | 54 Rear roller |
| 55 Front roller | 61 Cross arm |
| 62 Pivot arm | 63 Shoulder bolt |
| 64 Shoulder bolt | 70 High friction surface |
| 71 High friction surface | |

DETAILED DESCRIPTION OF THE DRAWINGS

Figure 1:
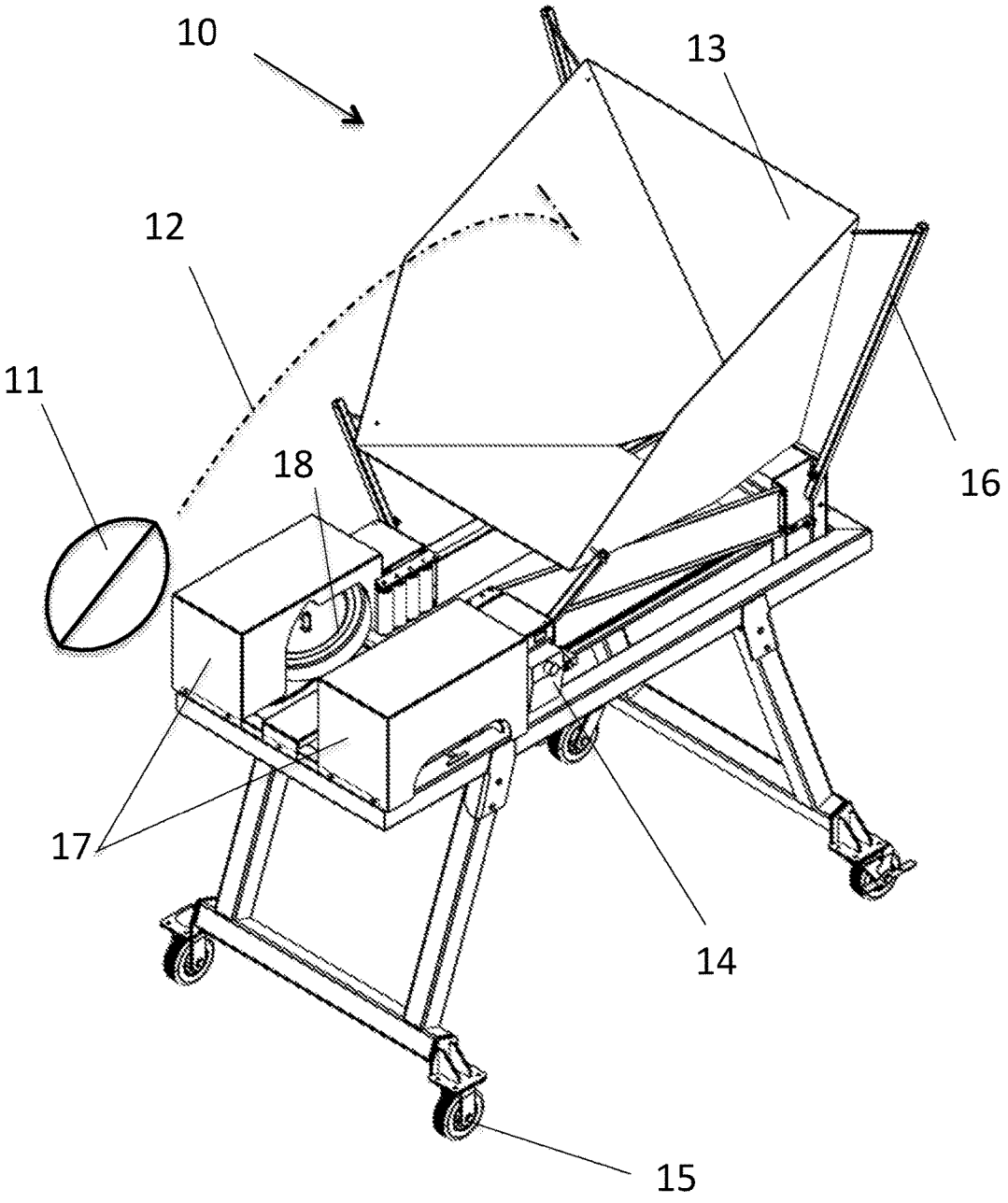
FIG. 1 is a view of the machine receiving a football.

FIG. 1 is a view of the machine 10 receiving a football 11. The machine 10 would operate as follows:

a. The user would position the machine 10 on a generally level area of the practice field.

b. The two rear casters 15 would be locked.

c. The machine 10 would be connected to a 120V electrical outlet.

d. The user would turn on the control 14. This would start the movement of the belt 39 and wheels 18, 24.

e. The user would move a throwing distance away from the machine 10.

f. The user would throw a football 11 into the machine 10 as shown in path 12.

g. The machine 10 would orient the football 11 and launch the football 11 to the user as shown in path 20 of FIG. 2.

h. The user would catch the football 11 and repeat steps (f) through (h) while practicing.

The collector 13 is a multisided flexible material such as netting, canvas cloth or plastic. It is held in place with four supports 16. The collector 13 absorbs the velocity of the football 11 and utilizes gravity to funnel the football 11 into the opening 30.

The guards 17 protect the user from inadvertant contact with the rotating wheels 18, 24.

Figure 2:
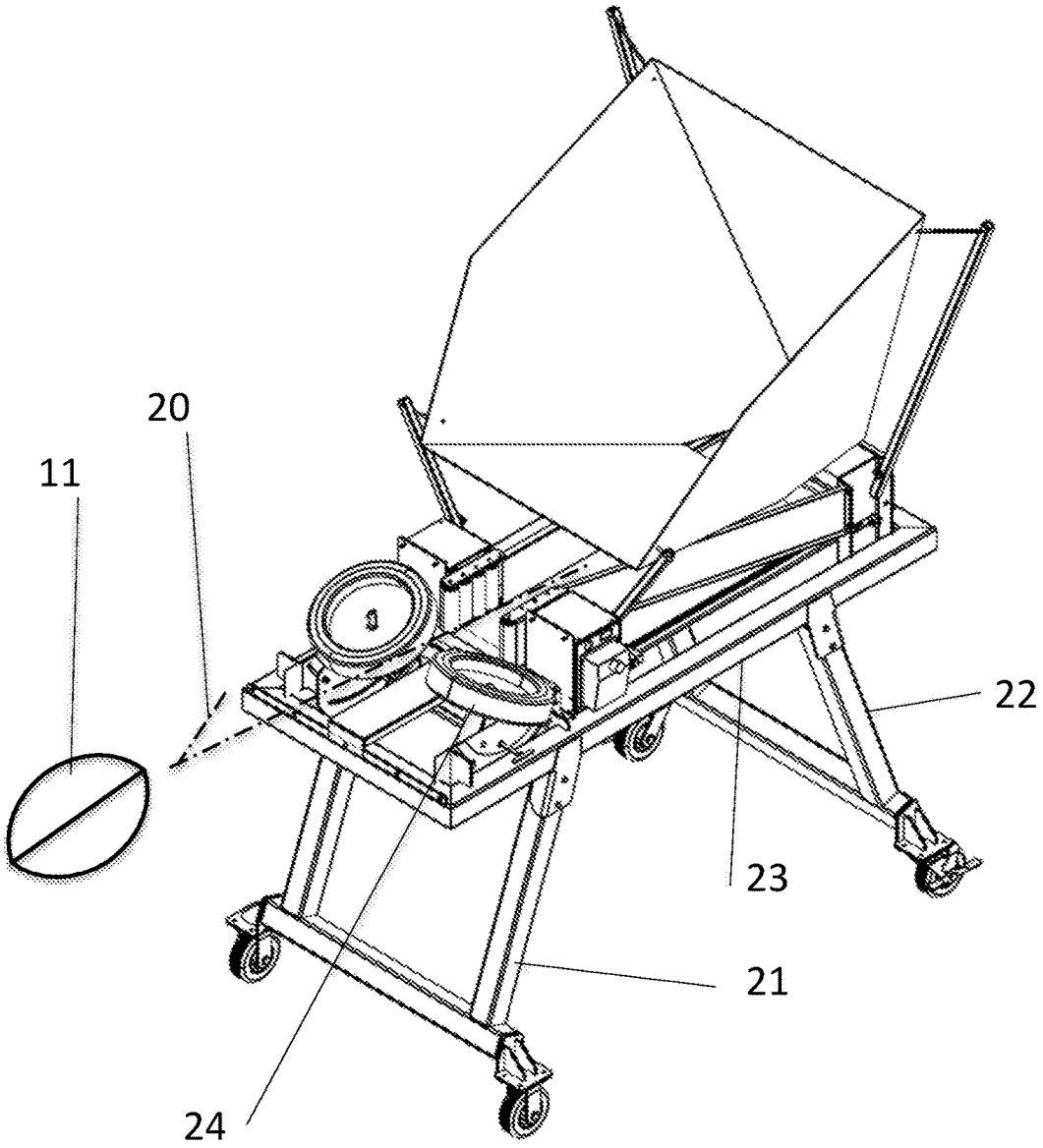
FIG. 2 is a view of the machine launching a football.

FIG. 2 is a view of the machine 10 launching a football 11. The frame 23 is supported by the front legs 21 and back legs 22. The material is generally steel tubing or steel plate. The construction is generally welded or bolted.

Figure 3:
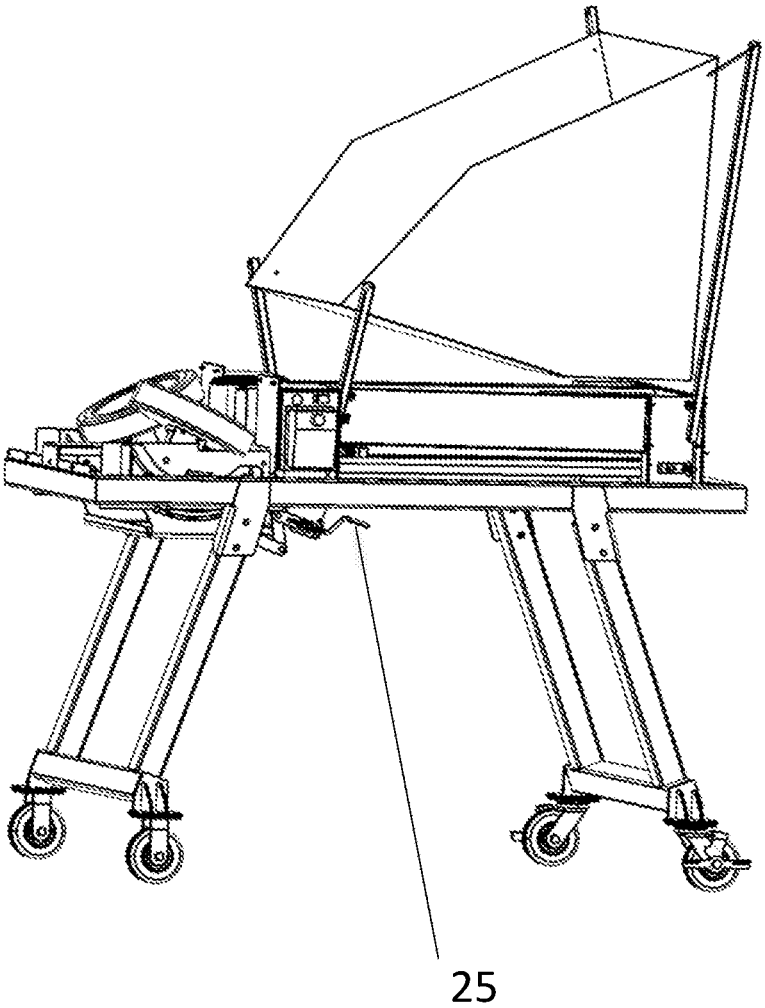
FIG. 3 is a side view of the machine.

FIG. 3 is a side view of the machine 10. The handle 25 is the user adjustment for changing the launching angle of the football 11. The speed of the motors 50 is adjustable with the rotating knob on the control 14. Precise football 11 launch is achieved via angle and speed adjustments.

Figure 4:
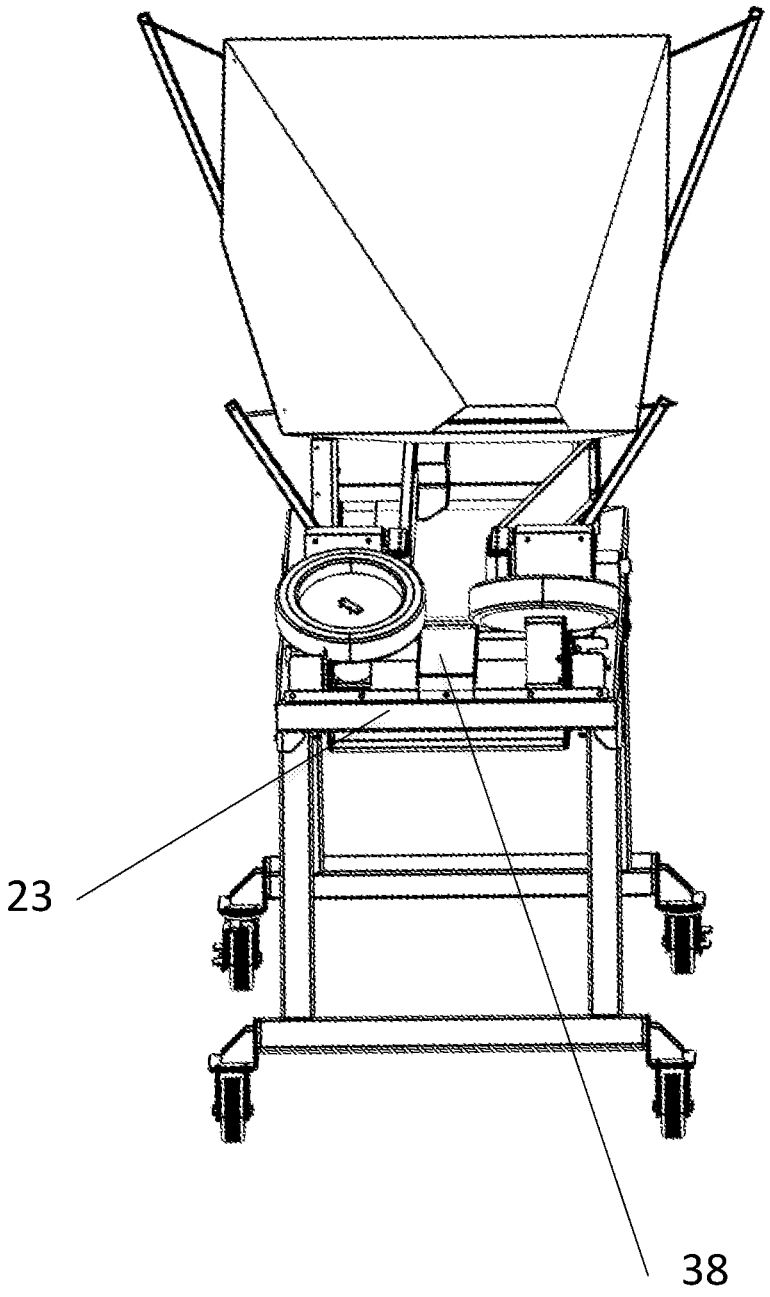
FIG. 4 is front view of the machine.

FIG. 4 is front view of the machine 10. The shelf 38 supports the football 11 as it passes through the wheels 18,24. The shelf 38 is fastened to the frame 23.

Figure 5:
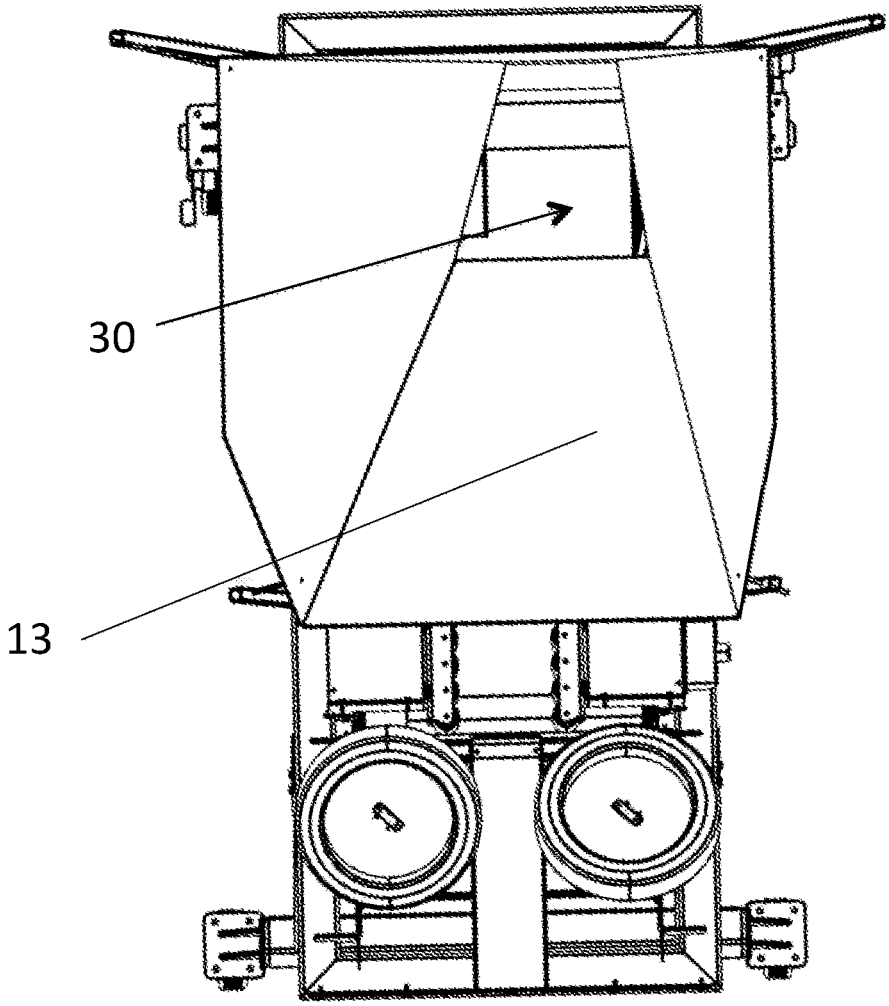
FIG. 5 is a top view of the machine.

FIG. 5 is a top view of the machine 10. The collector 13 includes four planar surfaces and surrounds the opening 30. The football 11 drops through the opening 30 with random orientation.

Figure 6:
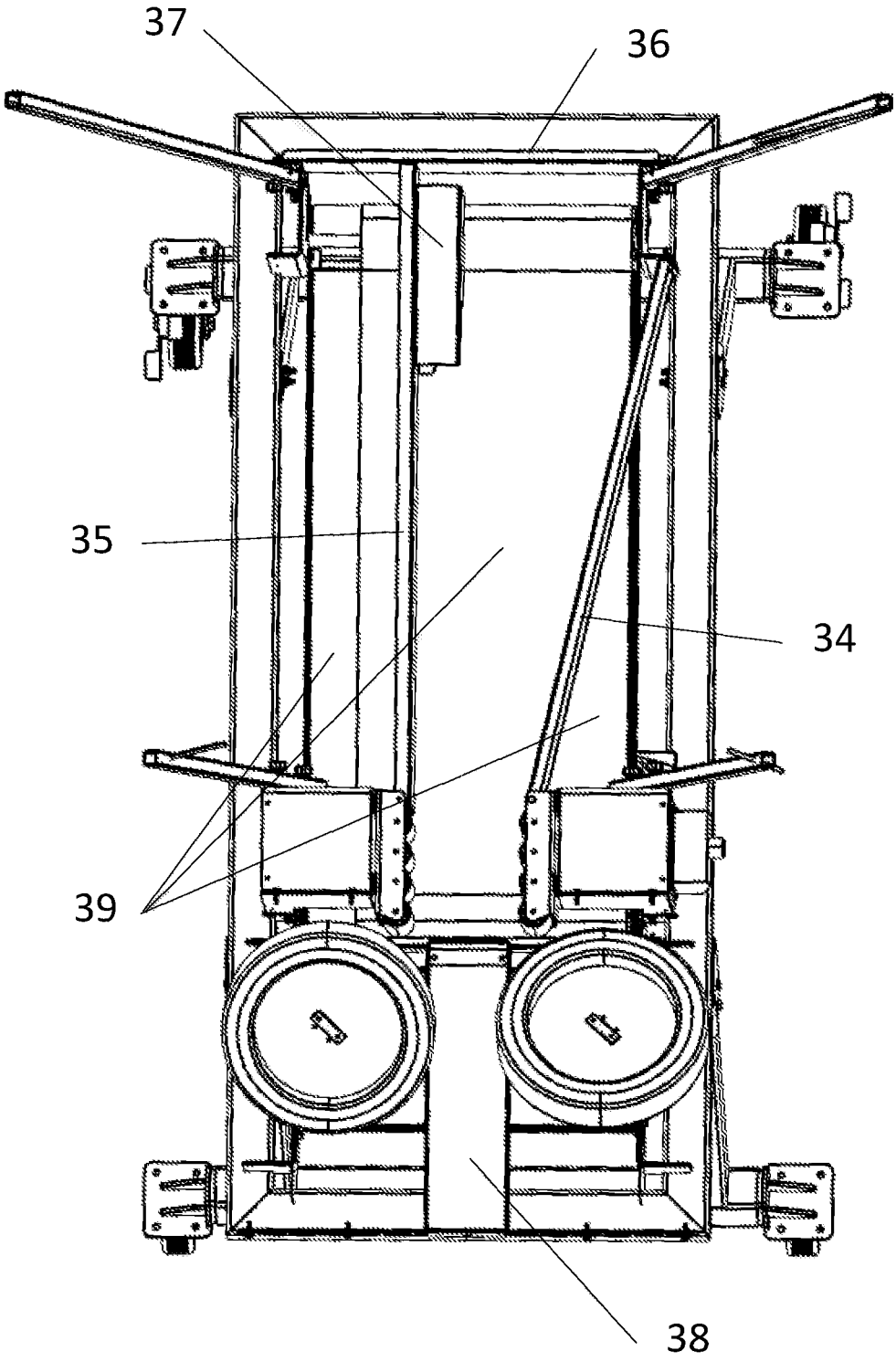
FIG. 6 is a top view of the machine without the collector.
Figure 7:
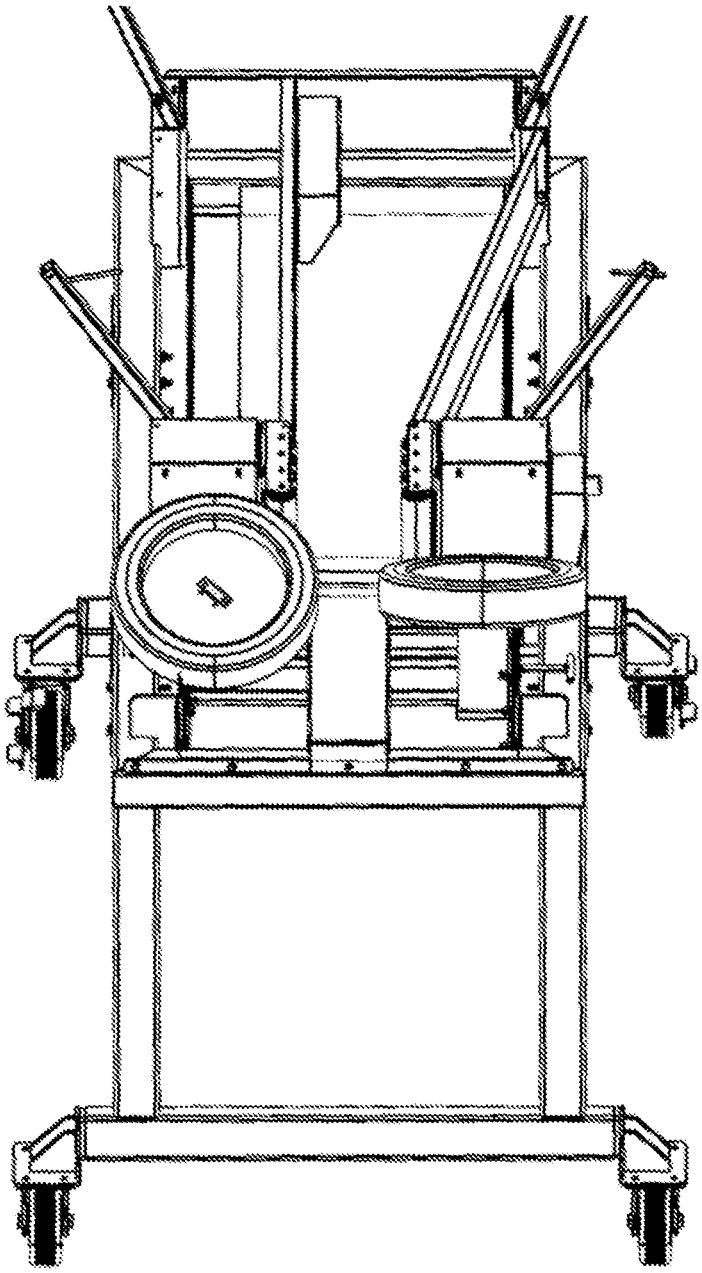
FIG. 7 is a front angled view of the machine.
Figure 8:
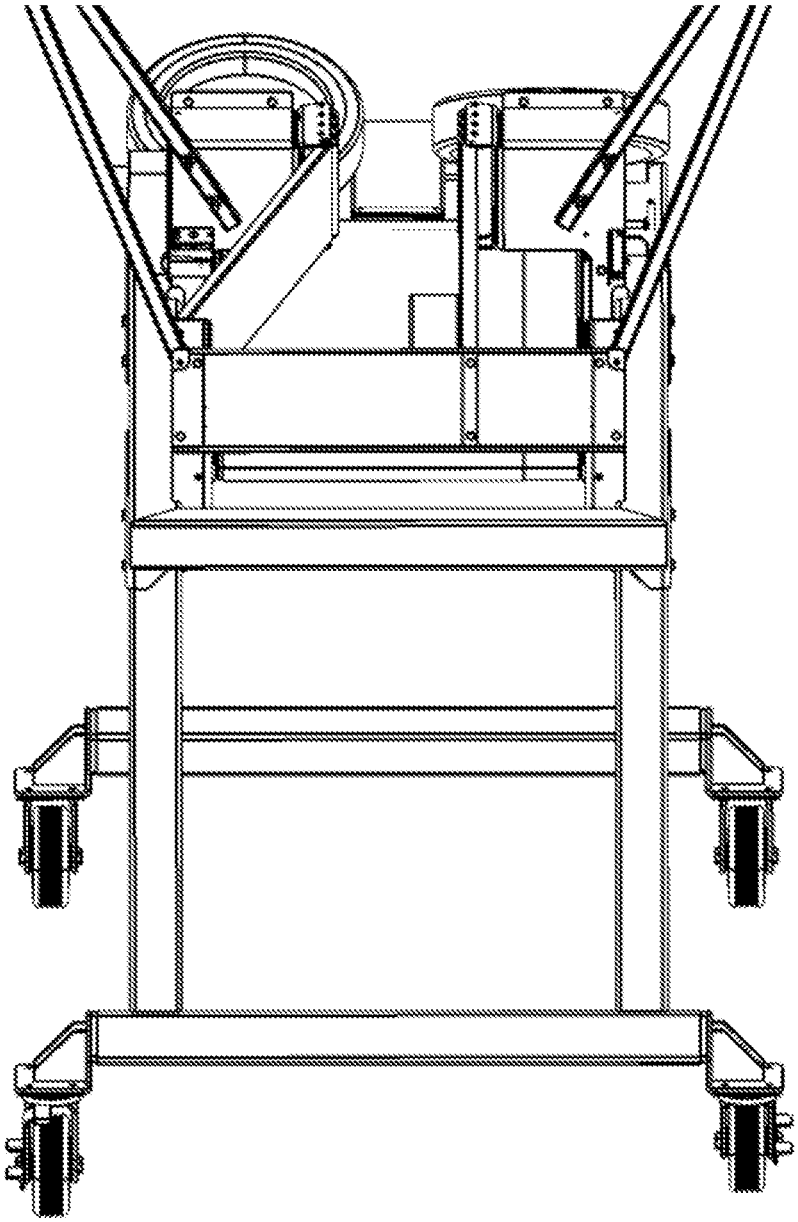
FIG. 8 is a rear angled view of the machine.

FIG. 6 is a top view of the machine 10 without the collector 13. In this view, the belt 39 moves from the rear to the front. The belt 39 provides the motion to carry the football 11 to the shelf 38. The left fence 35, rear fence 36, right fence 34 and kicker 37 are positioned slightly above the belt 39. These parts cause the football 11 to be oriented nose first as it moves forward. The belt 39 is level with the casters 15. Gravity is only used to pull the football 11 through the collector 13. While the football 11 is on the belt 39, gravity does not impart any sideways force on the football 11.

Figure 9:
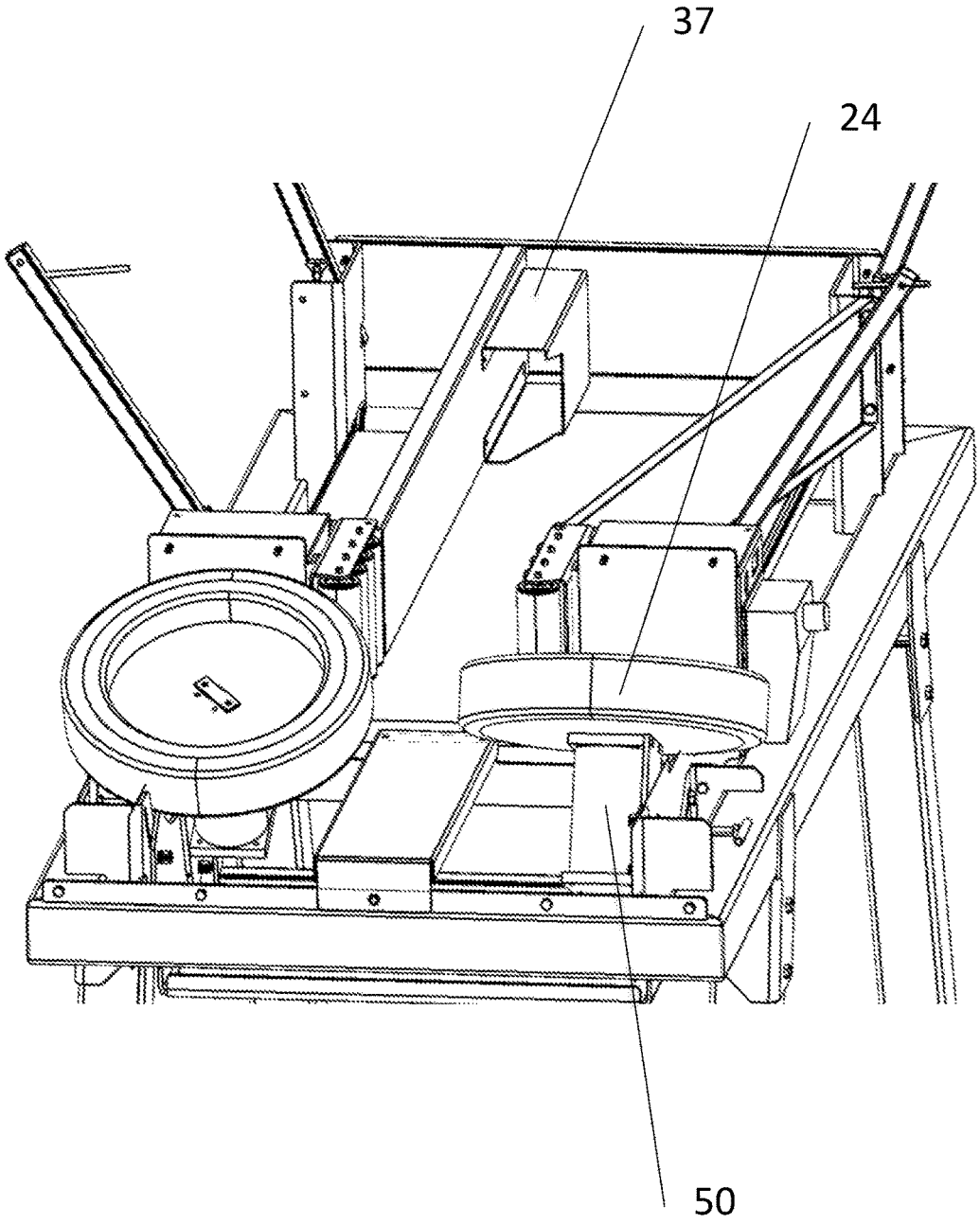
FIG. 9 is a front isometric view of the machine.

FIG. 9 is a front isometric view of the machine 10. Each wheel 18,24 is attached to a motor 50. The motor 50 includes a bracket for mounting.

The kicker 37 is attached to the left fence 35 which is attached to the frame 23. The purpose of the kicker 37 is to help orient the football 11 just after it passes through the opening 30.

Figure 10:
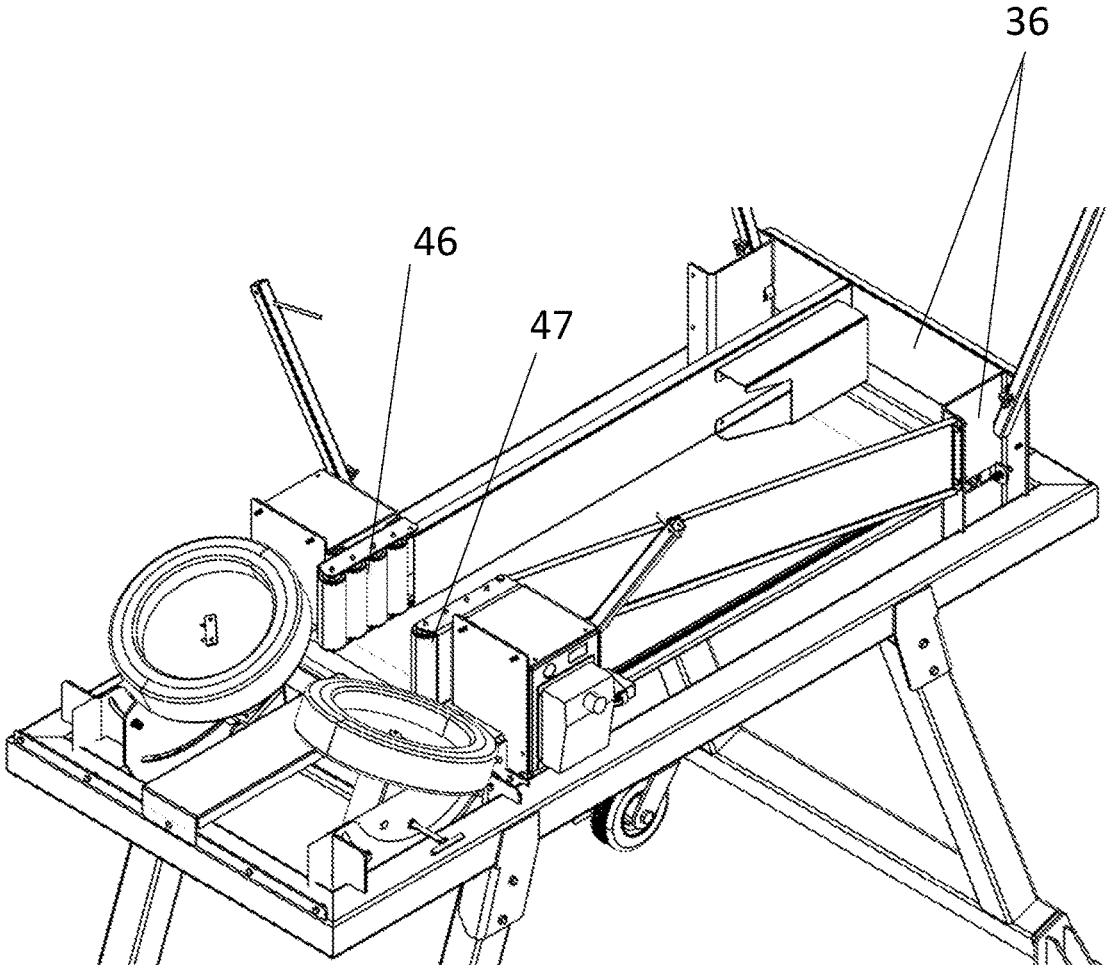
FIG. 10 is a right side isometric view of the machine.

FIG. 10 is a right side isometric view of the machine 10. The rear fence 36 includes a short section of front to rear fence. The left fence 35 transistions to the left rollers 46. The right fence 34 transistions to the right rollers 47.

Figure 11:
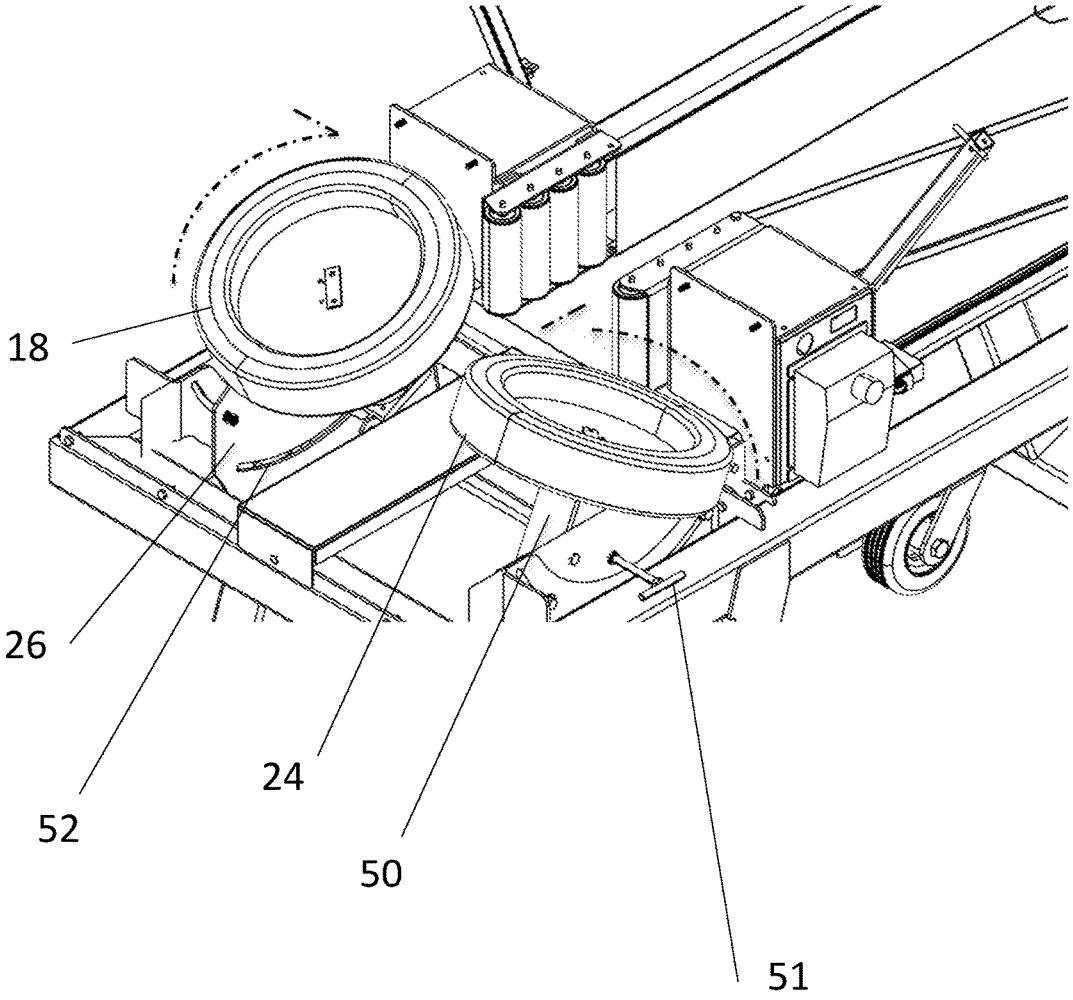
FIG. 11 is a right side isometric view of the drive wheels.
Figure 12:
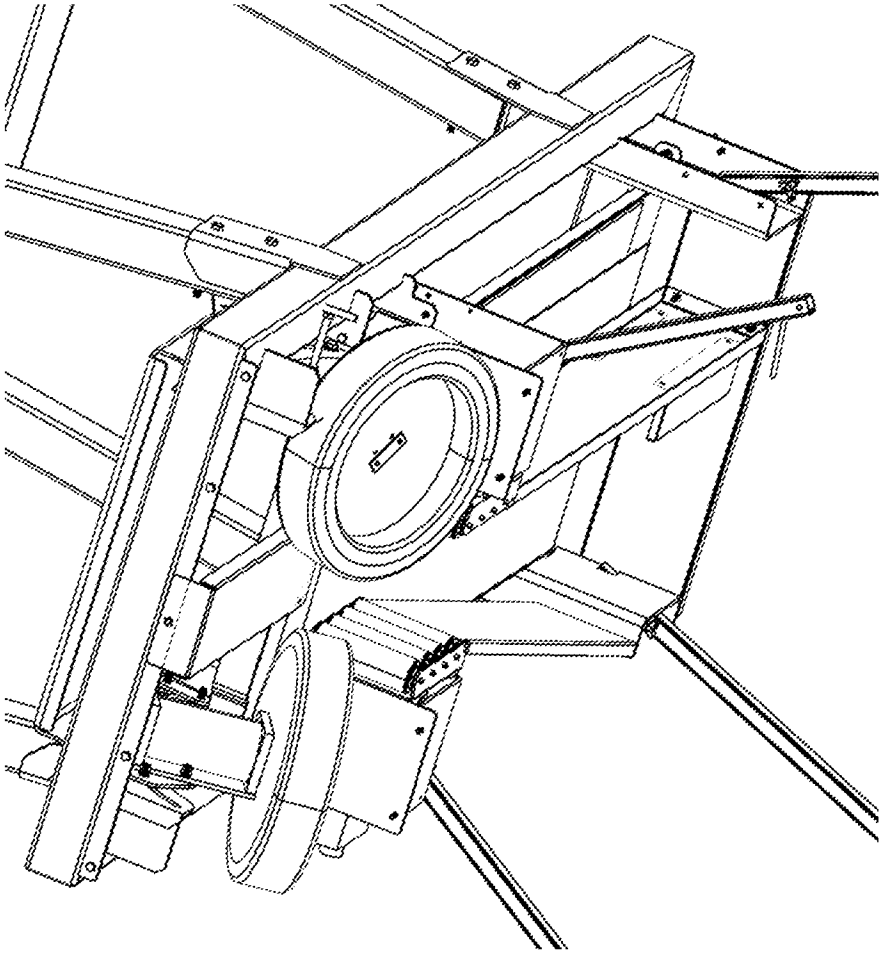
FIG. 12 is a left side isometric view of the machine.

FIG. 11 is a right side isometric view of the drive wheels 18, 24. The left wheel 18 rotates CW when viewed from the top. The right wheel 24 rotates CCW when viewed from the top. As shown in FIG. 11 (left wheel 18 tilted forward and right wheel 24 tilted rearward), the football 11 would launch with a right hand rotation. If a left hand rotation was desired, the left wheel 18 would be adjusted to tilt rearward and the right wheel 24 adjusted to tilt forward. To make this adjustment, the T handle 51 would be loosened and the motor 50 rotated in the arc slot 52 of the carrier 26.

Figure 13:
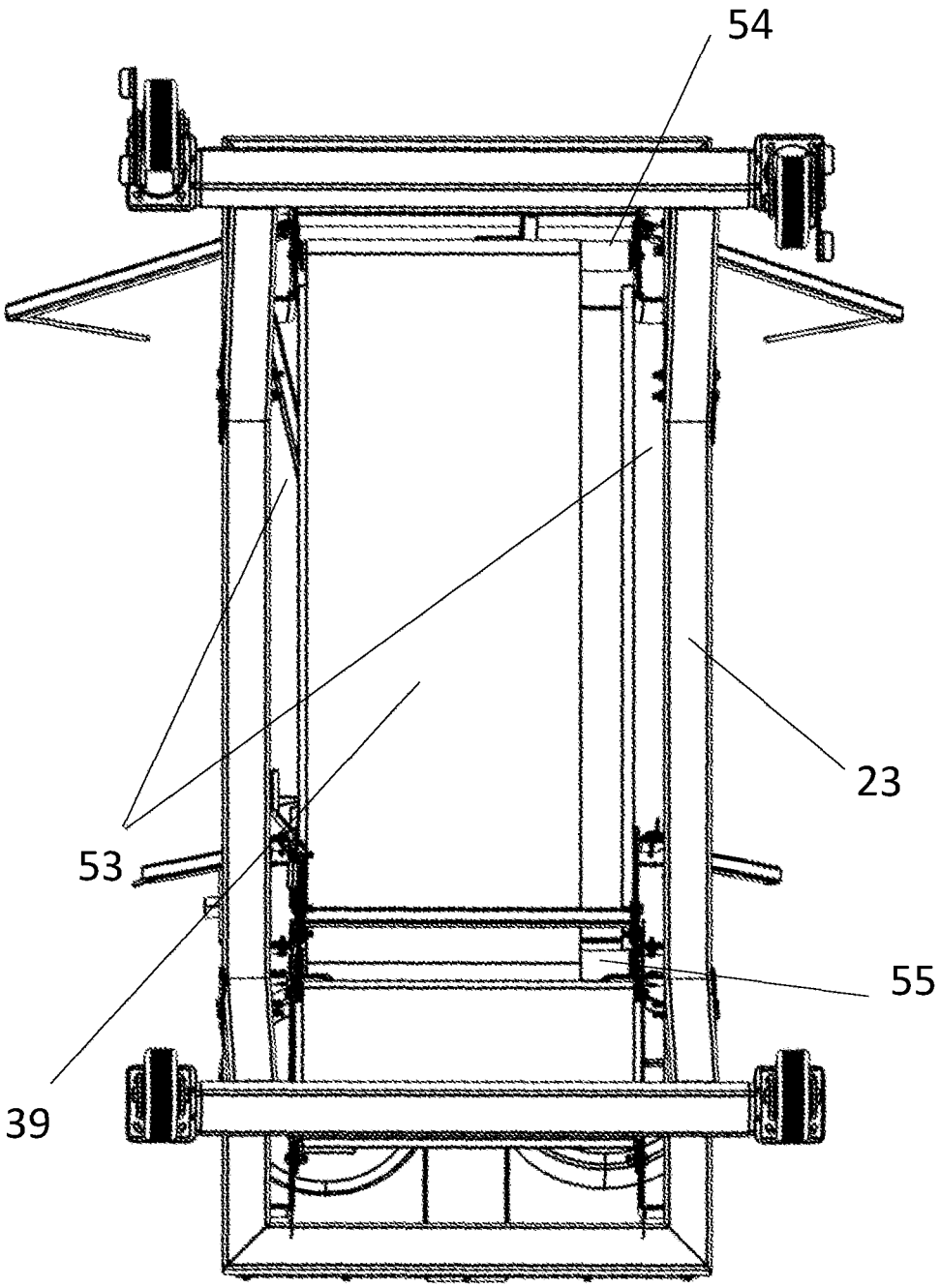
FIG. 13 is a bottom view of the machine.
Figure 14:
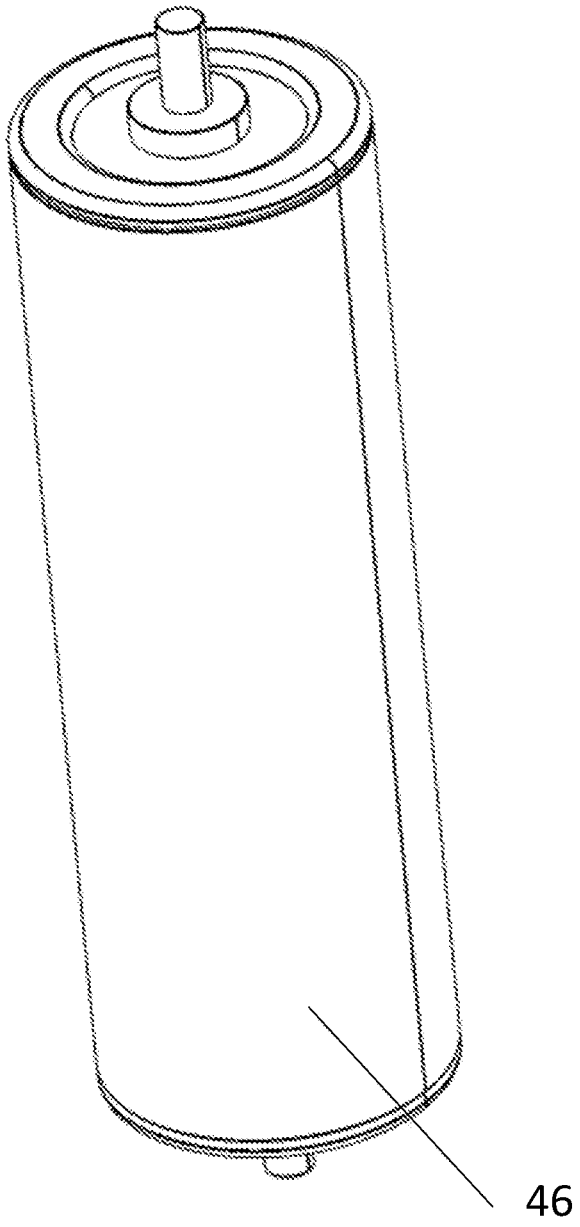
FIG. 14 is a view of the roller.
Figure 15:
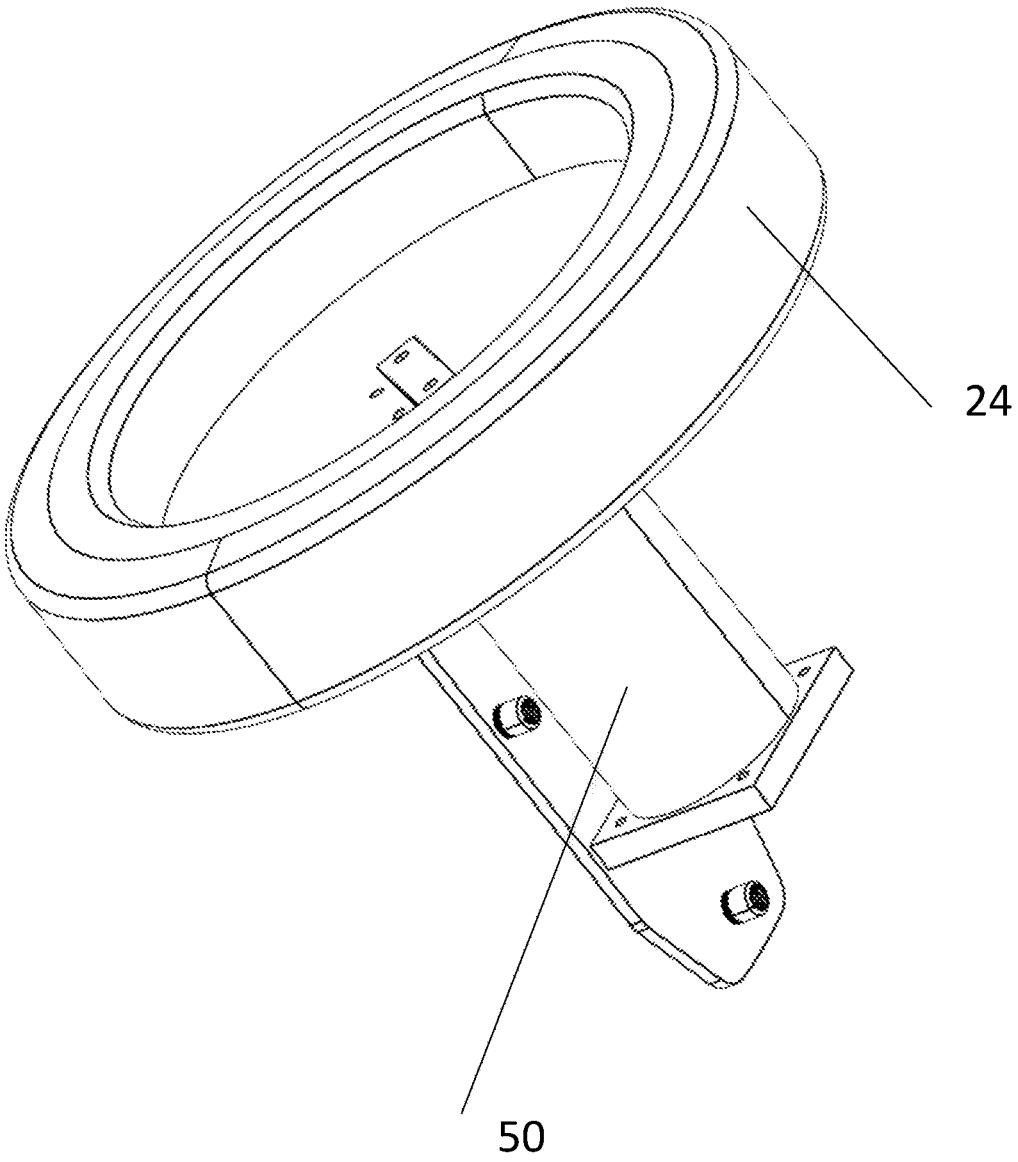
FIG. 15 is a view of the drive wheel.

FIG. 13 is a bottom view of the machine 10. The belt 39 as seen in this view would move from front to rear. The belt 39 is stretched over the rear roller 54 and the front roller 55. The roller 54, 55 axles are attached to the frame 23. The distance between the axles is adjustable to allow variation in belt 39 tension. The rear roller 54 is passive and the front roller 55 has an internal drive motor.

The belt board 53 is attached to the frame 23 and supports the upper surface of the belt 39. The belt 39 slides against the upper surface of the belt board 53.

Figure 16:
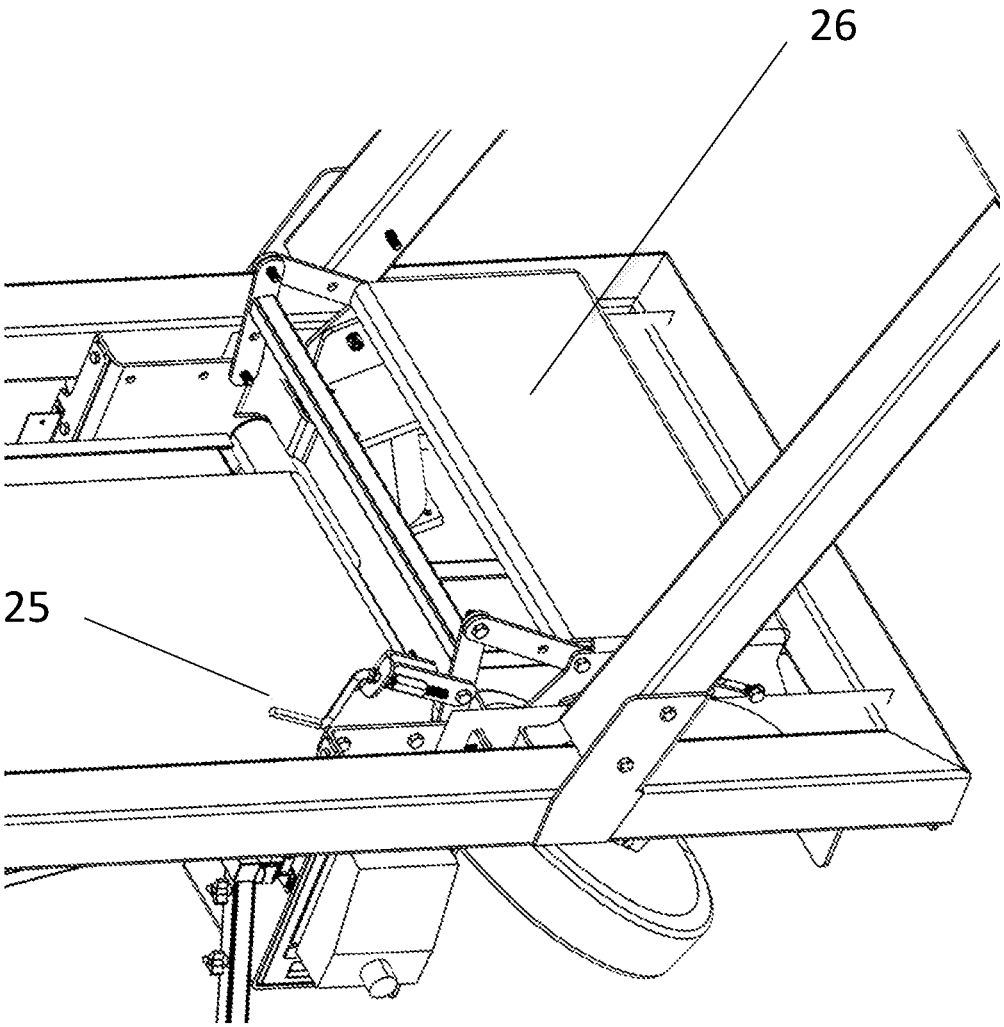
FIG. 16 is a bottom isometric view of the drive adjustment.

FIG. 16 is a bottom isometric view of the drive adjustment. Rotation of the handle 25 causes movement of the carrier 26.

Figure 17:
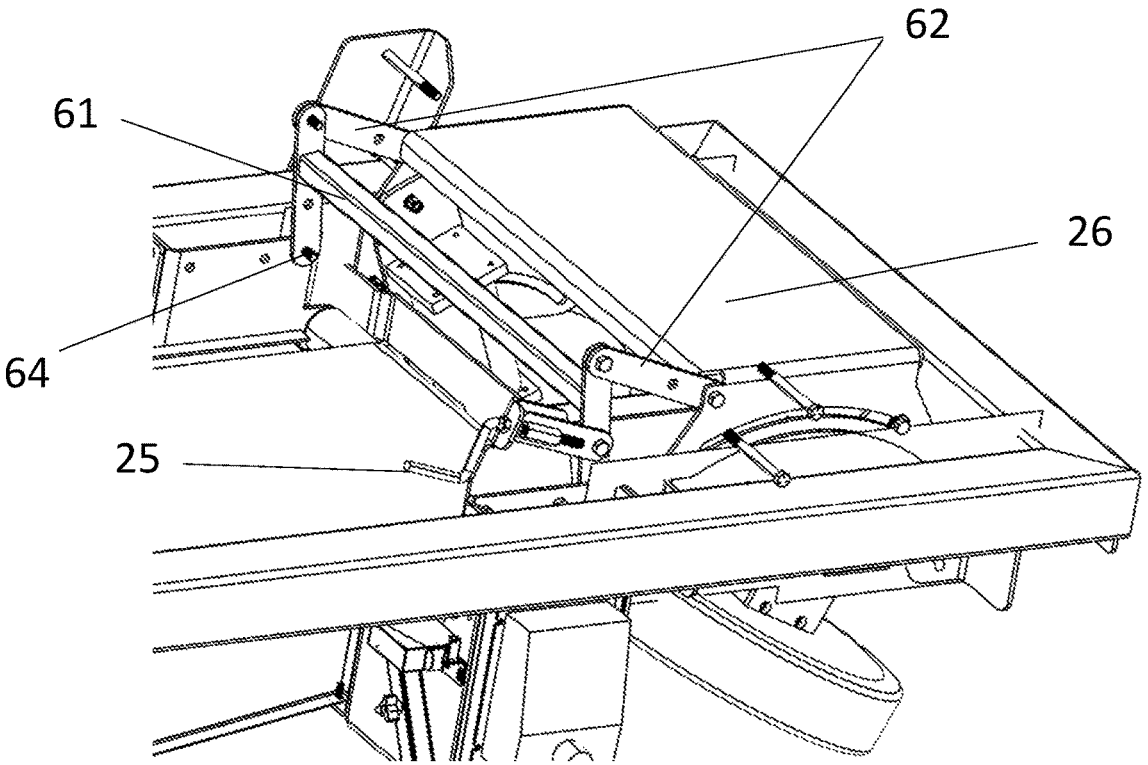
FIG. 17 is a bottom isometric view of the drive adjustment with the front leg removed.

FIG. 17 is a bottom isometric view of the drive adjustment with the front legs 21 removed. The movement of the carrier 26 is controlled with a four bar linkage. The first bar of the linkage is the frame 23. The second bar of the linkage is cross arm 61. The cross arm 61 rotates about shoulder bolt 64 which is connected to the frame 23. The third bar of the linkage is the pivot arm 62.

Figure 18:
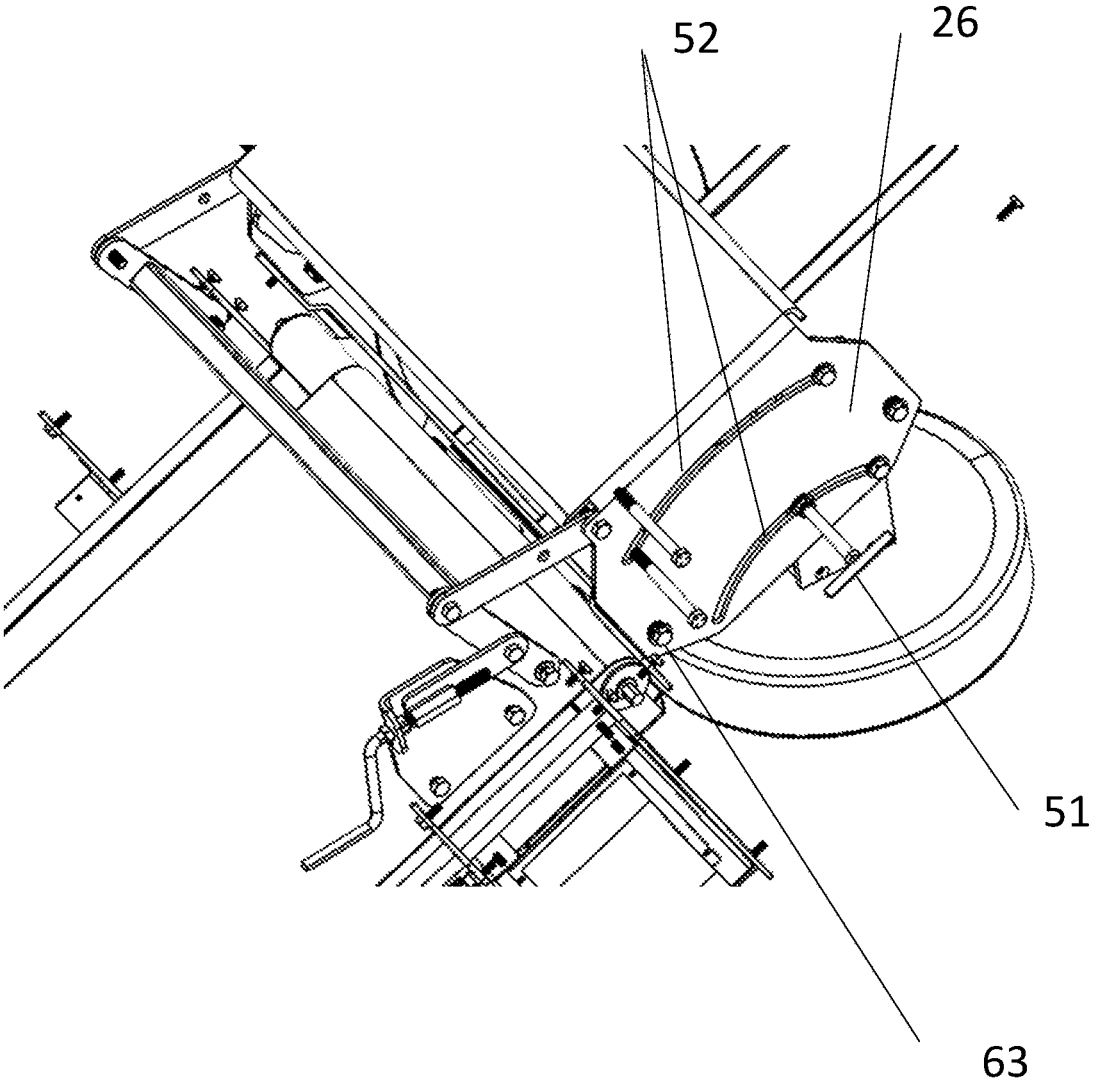
FIG. 18 is a bottom isometric view of the drive adjustment with the frame removed.

FIG. 18 is a bottom isometric view of the drive adjustment with the frame 23 removed. The fourth bar of the linkage is the carrier 26. The carrier 26 rotates about shoulder bolt 63 which is attached to the frame 23. This carrier 26 rotation causes the two drive motors 50 to change position in unison relative to the shelf 38.

The motor 50 tilt adjustment was discussed as part of FIG. 11. FIG. 18 also shows the details. After the T handle 51 is loosened, the motor 50 can be tilted along the arc slots 52.

Figure 19:
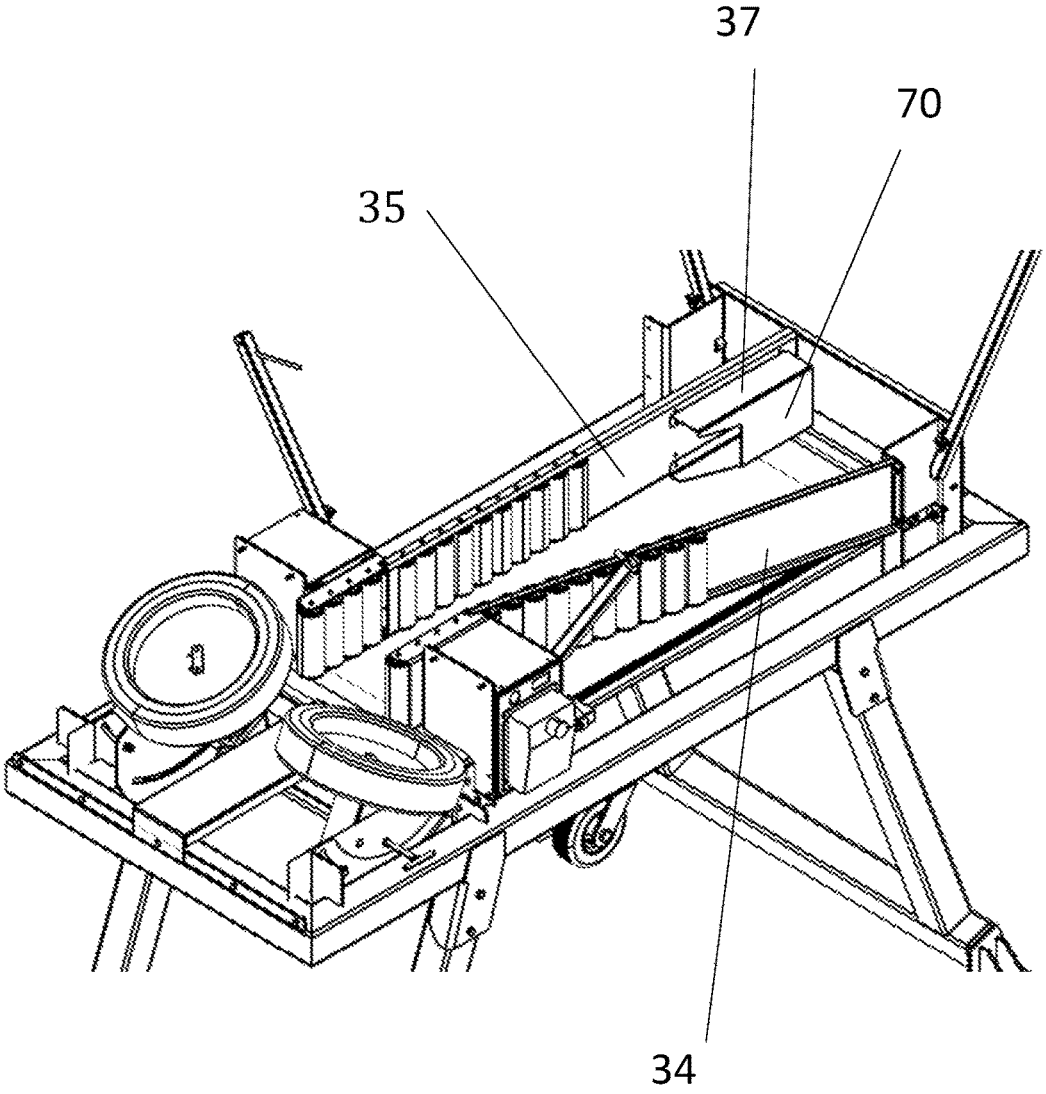
FIG. 19 is a side view of the machine with additional fence rollers.

FIG. 19 is a side view of the machine 10 with additional fence rollers 46. The right fence 34 is angled relative to the belt 39 motion. This angle is to cause the football 11 to be oriented nose first. After the width from left fence 35 to right fence 34 approached the length of the football 11, it is important to keep the sliding fiction low to prevent jamming.

High friction surface 70 is attached to this plane of the kicker 37. The high friction surface 70 would be sandpaper, rubber sheet, or similar material that would resist sliding action against the oval football 11.

Figure 20:
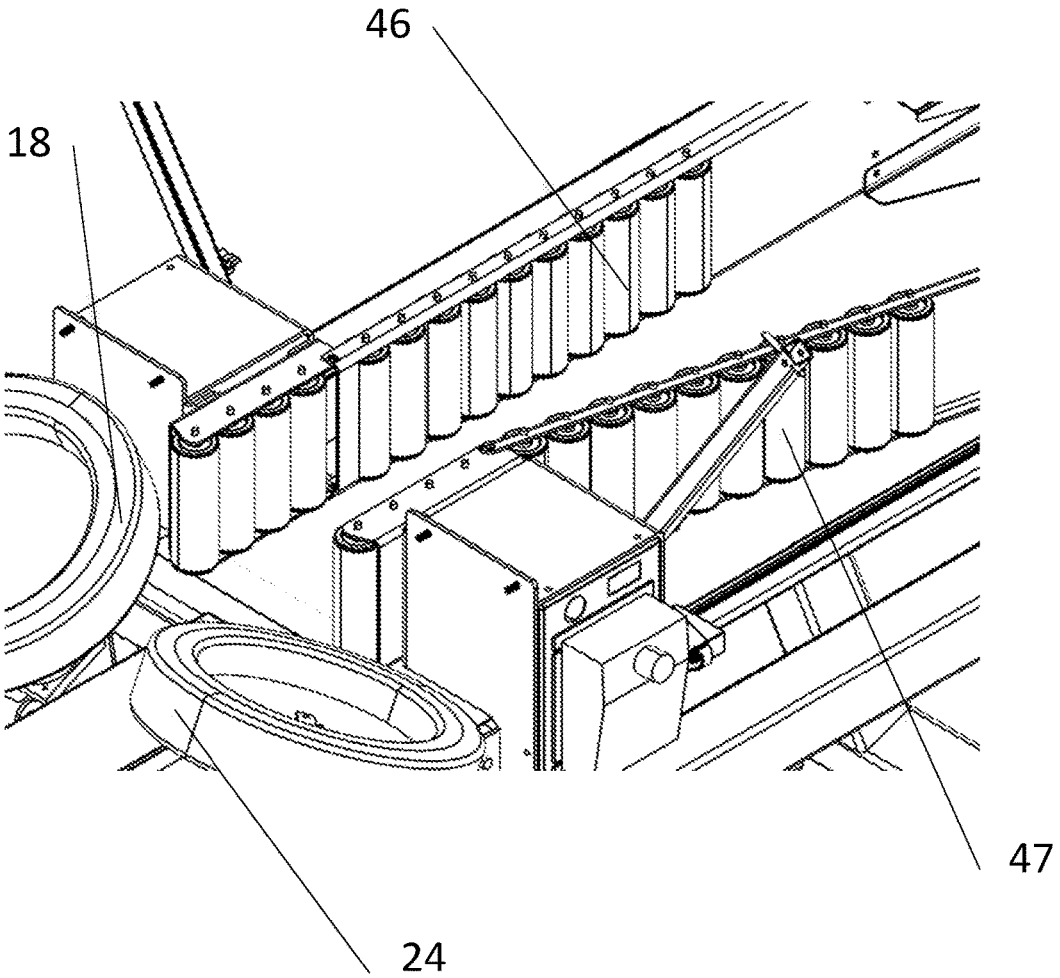
FIG. 20 is a side view of the drive wheels with additional fence rollers.

FIG. 20 is a side view of the drive wheels 18, 24 with additional fence rollers 46, 47. The fence rollers 46, 47 finish the orienting of the football 11.

Figure 21:
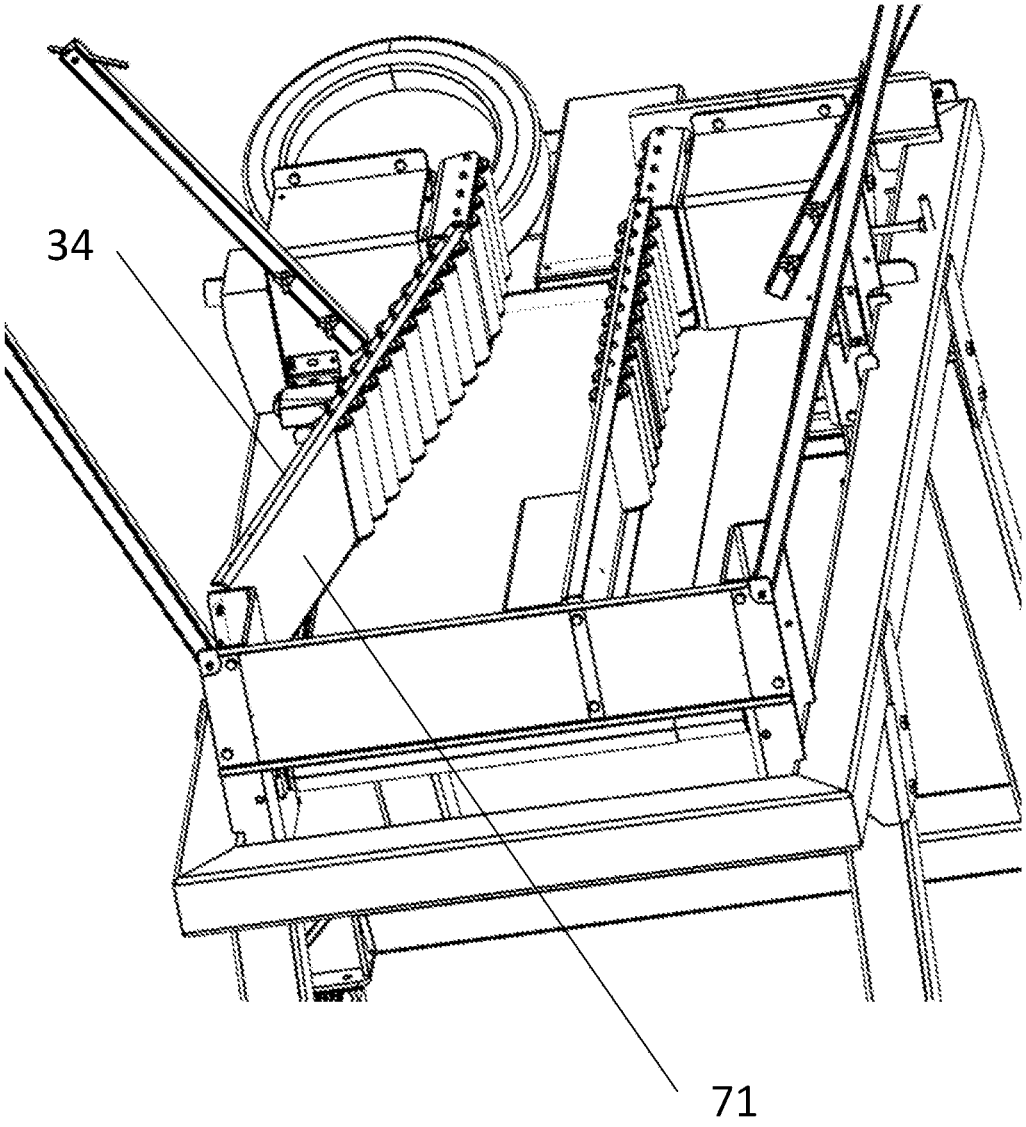
FIG. 21 is a rear view of the machine with additional fence rollers.

FIG. 21 is a rear view of the machine with additional fence rollers. High friction surface 71 is attached to the inside of the right fence 34. The high friction surface 71 would be sandpaper, rubber sheet, or similar material that would resist sliding action against the oval football 11.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawings and description in this disclosure are provided to help the reader understand the invention, and do not limit the scope of the claims.

The invention claimed is:

1. An oval football receiving and launching machine comprising:

(a) a collector to receive the oval football thrown into the collector; the collector comprises a rigid support structure and a flexible material which absorbs impact velocity of the oval football;

(b) an orientor comprising a moving belt, fences, vertical rollers and a motor; the fences and the vertical rollers are positioned above the moving belt; the fences and the vertical rollers steer the oval football on the moving belt; the motor is configured to operate the moving belt;

(c) an accelerator comprising two wheels and a second motor;

wherein the flexible material utilizes gravity to deliver the oval football to the orientor;

wherein the orientor delivers a pointed end of the oval football to the accelerator; and wherein the accelerator launches the oval football into the air.

2. The oval football receiving and launching machine of claim 1 wherein the moving belt is substantially level.

3. The oval football receiving and launching machine of claim 1 wherein the fences comprise a rear fence, a right fence, and a left fence.

4. The oval football receiving and launching machine of claim 3, further comprising a folded sheet metal shape attached to the inside juncture of the rear fence and the left fence; and wherein a high friction surface is attached to a planar surface of the folded sheet metal shape opposite the right fence.

5. The oval football receiving and launching machine of claim 1 wherein the accelerator further includes means to adjust a launch angle of the oval football.

6. The oval football receiving and launching machine of claim 5 wherein the means to adjust a launch angle of the oval football comprises a four bar linkage.

7. An oval football receiving and launching machine comprising:

(a) a collector to receive the oval football thrown into the collector;

wherein the collector includes means to decelerate and steer the oval football;

(b) an orientor which includes means to move and steer the oval football;

(c) an accelerator which includes means to launch the oval football into the air;

wherein the collector utilizes gravity to deliver the oval football to the orientor;

wherein the orientor delivers a pointed end of the oval football to the accelerator; and wherein the accelerator further includes means to adjust a launch angle of the oval football.

8. The oval football receiving and launching machine of claim 7 wherein the means to move and steer the oval football comprises a moving belt, a rear fence, a right fence, a left fence, vertical rollers, and a motor.

9. The oval football receiving and launching machine of claim 8 wherein the left fence is perpendicular to the rear fence, and the right fence is at an acute angle to the rear fence.

10. The oval football receiving and launching machine of claim 9 wherein over 50% of the moving belt is surrounded by the rollers.

11. The oval football receiving and launching machine of claim 7 wherein the means to launch the oval football comprises two wheels and a motor.

12. The oval football receiving and launching machine of claim 9 wherein a high friction surface is attached to a planar surface of the right fence opposite the left fence.

13. The oval football receiving and launching machine of claim 7 wherein the means to adjust a launch angle of the oval football comprises a four bar linkage.

14. A method of receiving and launching an oval football, the method comprising:

receiving a thrown oval football in a collector;

wherein the collector comprises a rigid support structure and a flexible material;

decelerating the oval football against the flexible material;

utilizing gravity to deliver the oval football to an orientor;

wherein the orientor comprises a moving belt, fences, vertical rollers, and a motor;

delivering the oval football in a nose forward position into an accelerator;

wherein the accelerator comprises two wheels and a second motor;

moving the oval football between the two wheels; and launching the oval football into the air.

15. The method of claim 14 wherein the moving belt is substantially level.

16. The method of claim 14 wherein the fences comprise a rear fence, a right fence, and a left fence.

17. The method of claim 16, wherein a high friction surface is attached to a planar surface of the right fence opposite the left fence.

18. The method of claim 14, wherein over 50% of the moving belt is surrounded by the rollers.

19. The method of claim 14, wherein all steps are automatic without user interaction.

20. The method of claim 14 wherein the accelerator further comprises a 4 bar linkage to adjust a launch angle of the oval football.

* * * * *